US009212474B2

(12) United States Patent
Ye et al.

(10) Patent No.: US 9,212,474 B2
(45) Date of Patent: Dec. 15, 2015

(54) QUICK ASSEMBLY AND DISASSEMBLY MECHANISM FOR FAUCET

(71) Applicant: XIAMEN LOTA INTERNATIONAL CO., LTD., Xiamen (CN)

(72) Inventors: Liming Ye, Xiamen (CN); Shuanglin Bai, Xiamen (CN); Jianping Zhou, Xiamen (CN)

(73) Assignee: XIAMEN LOTA INTERNATIONAL CO., LTD., Xiamen, Fujian (CN)

( * ) Notice: Subject to any disclaimer, the term of this patent is extended or adjusted under 35 U.S.C. 154(b) by 233 days.

(21) Appl. No.: 14/072,756

(22) Filed: Nov. 5, 2013

(65) Prior Publication Data

US 2014/0182708 A1 Jul. 3, 2014

(30) Foreign Application Priority Data

Dec. 31, 2012 (CN) ..... 2012 2 0745036 U

(51) Int. Cl.

| | |
|---|---|
| ***F16L 5/00*** | (2006.01) |
| ***E03B 1/00*** | (2006.01) |
| ***E03C 1/086*** | (2006.01) |
| ***F15B 13/00*** | (2006.01) |
| ***F16K 21/00*** | (2006.01) |
| ***E03C 1/00*** | (2006.01) |
| ***E03C 1/042*** | (2006.01) |
| ***E03C 1/04*** | (2006.01) |
| *E03C 1/02* | (2006.01) |

(52) U.S. Cl.

CPC ..... *E03C 1/0401* (2013.01); *E03C 1/021* (2013.01); *E03C 1/0402* (2013.01); *E03C 1/0403* (2013.01); *Y10T 137/598* (2015.04); *Y10T 137/6014* (2015.04); *Y10T 137/6977* (2015.04); *Y10T 137/87579* (2015.04); *Y10T 137/9464* (2015.04)

(58) Field of Classification Search

CPC ..... Y10T 137/6977; Y10T 137/6014; Y10T 137/87579; Y10T 137/9464; E03C 1/0401; E03C 1/021; E03C 1/0402; E03C 1/0403; E03C 2201/50

USPC ..... 137/359, 315.12, 603, 801; 4/696, 695, 4/675–678; 285/314, 317, 323, 421, 399, 285/342, 343, 255

See application file for complete search history.

(56) References Cited

U.S. PATENT DOCUMENTS

| | | | | |
|---|---|---|---|---|
| 4,456,287 | A * | 6/1984 | Bisonaya | 285/281 |
| 5,340,252 | A * | 8/1994 | Weddendorf | 411/267 |
| 5,375,887 | A * | 12/1994 | Johnson | 285/12 |
| 6,820,291 | B1 * | 11/2004 | Weaver | 4/695 |
| 2009/0255588 | A1 * | 10/2009 | Bors et al. | 137/15.01 |
| 2010/0272503 | A1 * | 10/2010 | Pitsch et al. | 403/21 |

* cited by examiner

*Primary Examiner* — John K Fristoe, Jr.
*Assistant Examiner* — Kelsey Rohman

(57) ABSTRACT

A quick assembly and disassembly mechanism for a faucet includes a main body, a movable lock block disposed in the main body, a press plate which is movably disposed on the main body, and push blocks which are movably disposed on the main body and driven by the press plate. When the main body is moved to the counter top to compress the press plate, the press plate will hold against the push blocks to push the lock block to mesh with the bolt tightly, so that the faucet can be mounted and dismounted quickly. The assembly and disassembly of the faucet and the related parts is more convenient and quick.

6 Claims, 4 Drawing Sheets

QUICK ASSEMBLY AND DISASSEMBLY MECHANISM FOR FAUCET

BACKGROUND OF THE INVENTION

1. Field of the Invention

The present invention relates to a quick assembly and disassembly mechanism, and more particularly to a quick assembly and disassembly mechanism for a faucet or other related parts.

2. Description of the Prior Art

When a faucet is installed at one side of a sink, a nut is used to mesh with the bolt at the lower end of the faucet so that the faucet can be installed on the counter top. The faucet of the kitchen and the bathroom is installed close to the wall. Subject to the shape of the kitchen sink and the bathroom sink, the space under the counter top to lock the faucet is very small. According to the traditional operation to lock the nut on the bolt, the nut must be rotated from the lower end of the bolt. The length of the bolt depends on the thickness of the counter top, namely, it decides the route of the nut to be locked. Thus, to lock or unlock the nut takes time and energy.

In order to install the faucet quickly, a quick assembly structure for faucets is developed on the market. This structure achieves quick installation through a one-way engagement way. However, when dismounted, the nut must be dismounted from the highest position to the distal of the bolt. It also takes time and energy. Because the space under the counter top is narrow, it is difficult to operate. The faucet cannot be dismounted quickly. Accordingly, the inventor of the present invention has devoted himself based on his many years of practical experiences to solve these problems.

SUMMARY OF THE INVENTION

The primary object of the present invention is to provide a quick assembly and disassembly mechanism for installing a faucet and its related parts quickly and conveniently.

In order to achieve the aforesaid object, the quick assembly and disassembly mechanism of the present invention, cooperating with a bolt at the lower portion of a faucet or other parts, comprises a main body, a movable lock block disposed in the main body, a press plate which is movably disposed on the main body, and push blocks which are movably disposed on the main body and driven by the press plate. The movable lock block is composed of at least two movable blocks and at least one return elastic member to return the at least two movable blocks outward. The inner wall of each movable block is formed with a mate surface corresponding to the outer wall of the bolt. The mate surface is provided with an anti-disengagement device. The press plate is an annular plate. The lower portion of the press plate is movably inserted in the main body. The lower surface of the press plate is in touch with the upper surfaces of the push blocks. The push blocks correspond in number to the movable blocks. Each push block is formed with a push portion corresponding to a guide portion of the corresponding movable block. When the push blocks sink into the main body, the push portions of the push blocks will push the movable blocks to mesh with the bolt tightly.

Preferably, the anti-disengagement device is one of threads, teeth, knurls and protrusions.

Preferably, the push portion and the guide portion are one of inclined surfaces, inclined groove, slide grooves, guide rails and guide grooves to mate with each other.

Preferably, the outer wall of the main body has a drive portion for applying a force.

Preferably, the upper portion of the main body has a receiving seat. Two sides of the receiving seat at the upper portion of the main body are formed with two mate holes which are arranged in a line. A connecting ring is provided in the receiving seat. A buckle is provided to connect the connecting ring to the main body. The outer diameter of the connecting ring corresponds to the inner diameter of the receiving seat. The connecting ring has an end surface at an upper end thereof, a socket at a lower portion thereof for accommodating the movable lock block, a central through hole for insertion of the bolt, mate holes for mate portions of the press plate to pass through, slots on the end surface for the push blocks to pass through, and a pair of notches at an outer wall of the socket of the connecting ring, corresponding to the mate holes at the two sides of the receiving seat, for the buckle to pass through transversely.

Preferably, the return elastic member of the movable lock block is a C-shaped ring disposed between the two movable blocks. The two movable blocks each have a positioning groove to cooperate with the C-shaped ring. The guide portion on the outer wall of each movable block is an inclined surface which is inclined outward from top to bottom.

Preferably, the upper portion of the press plate is an end cap. The end cap has a central through hole for insertion of the bolt and two hooks extending downward to form mate portions of the press plate.

Accordingly, the present invention has the movable lock block in the main body and the press plate and the push blocks on the main body to push the lock block. Normally, the main body can be moved up and down on the bolt of the faucet. It is not necessary to rotate the main body from the bottom end of the bolt. When the main body is moved to the counter top to compress the press plate, the press plate will hold against the push blocks to push the lock block to mesh with the bolt tightly, so that the faucet can be mounted and dismounted quickly. The assembly and disassembly of the faucet and the related parts is more convenient and quick.

DETAILED DESCRIPTION OF THE PREFERRED EMBODIMENTS

Figure 1:
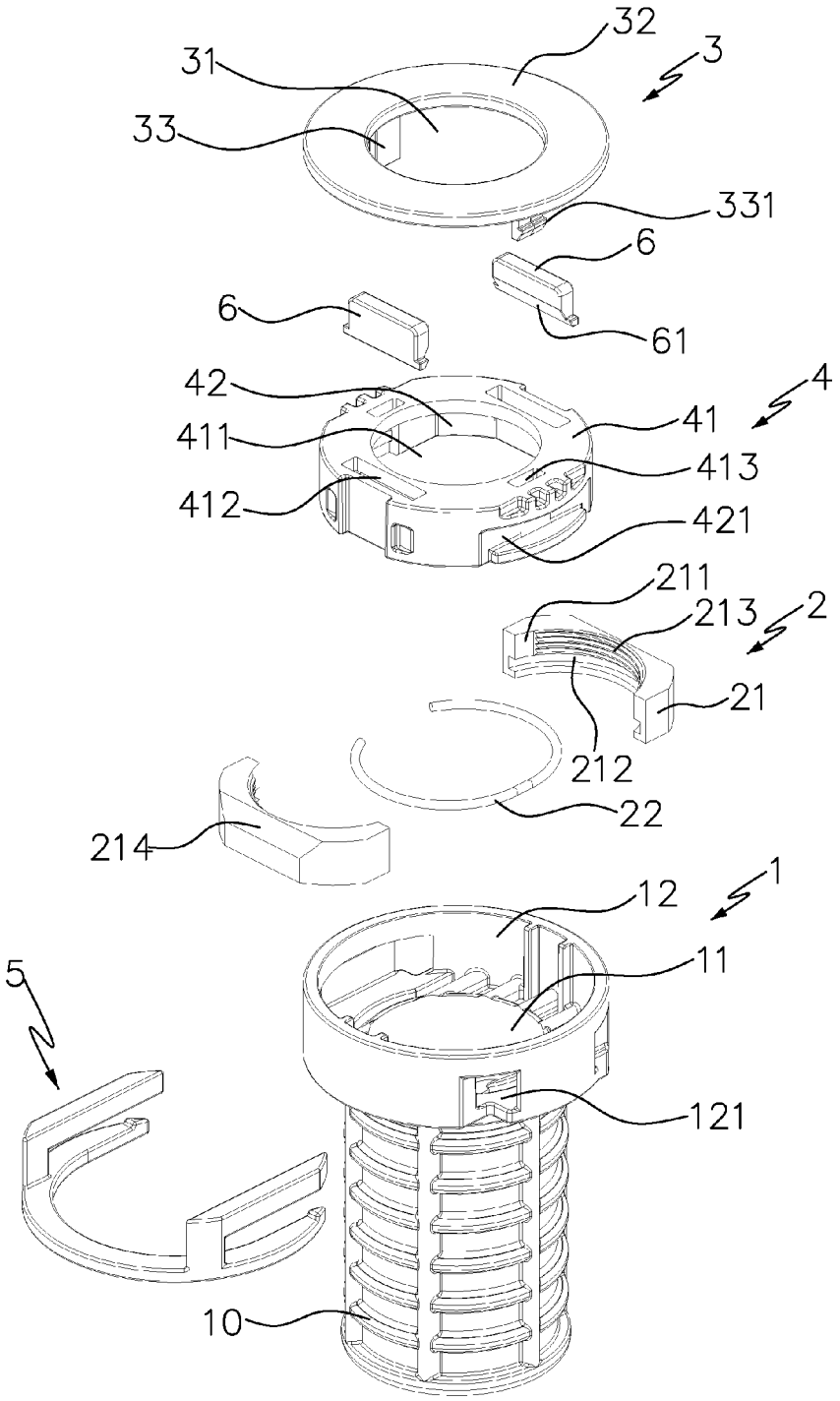
FIG. 1 is an exploded view according to a preferred embodiment of the present invention.

Embodiments of the present invention will now be described, by way of example only, with reference to the accompanying drawings.

As shown in FIG. 1 to FIG. 4, the present invention discloses a quick assembly and disassembly mechanism for installing a faucet and its related parts. The assembly and disassembly mechanism is movably fitted on the bolt B at the lower portion of the faucet to fix the faucet on the kitchen sink or the bathroom sink or on the counter top A. The mechanism comprises a main body 1, a movable lock block 2 disposed in the main body 1, a press plate 3 which is movably disposed on the main body 1, and push blocks 6 which are movably disposed on the main body 1 and driven by the press plate 3.

The outer wall of the main body 1 has a drive portion 10 for rotating the main body 1 by applying a force. The main body 1 has a central through receiving cavity 11. The upper portion of the receiving cavity 11 is formed with a receiving seat 12 to accommodate the movable lock block 2.

The movable lock block 2 is composed of at least two movable blocks 21 and at least one return elastic member 22. The inner wall of each movable block 21 is formed with a mate surface 211 corresponding to the outer wall of the bolt B. The mate surface 211 is provided with an anti-disengagement device 213. The anti-disengagement device 213 includes threads, teeth, knurls, protrusions or the like. The outer wall of each movable block 21 has a guide portion 214 to cooperate with a push portion 61 of the push block 6 for the movable block 21 to be moved inward. The return elastic member 22 cooperates with the movable blocks 21 to bring the movable blocks 21 to the initial state.

The press plate 3 is an annular plate. The lower portion of the press plate 3 is movably inserted in the main body 1 and in touch with the push blocks 6. The upper portion of the press plate 3 is an end cap 32. The end cap 32 has a central through hole 31 for insertion of the bolt B and two hooks 331 extending downward to form mate portions 33 of the press plate 3.

The push blocks 6 correspond in number to the movable blocks 21. Each push block 6 is formed with a push portion 61 corresponding to the guide portion 214 of the corresponding movable block 21. When the push blocks 6 sink to the utmost position of the main body 1, the push portions 61 of the push blocks 6 push the movable blocks 21 to mesh with the bolt B tightly.

The push portion 61 and the guide portion 214 are inclined surfaces, inclined groove, slide grooves, guide rails, guide grooves or the like to mate with each other.

Figure 2:
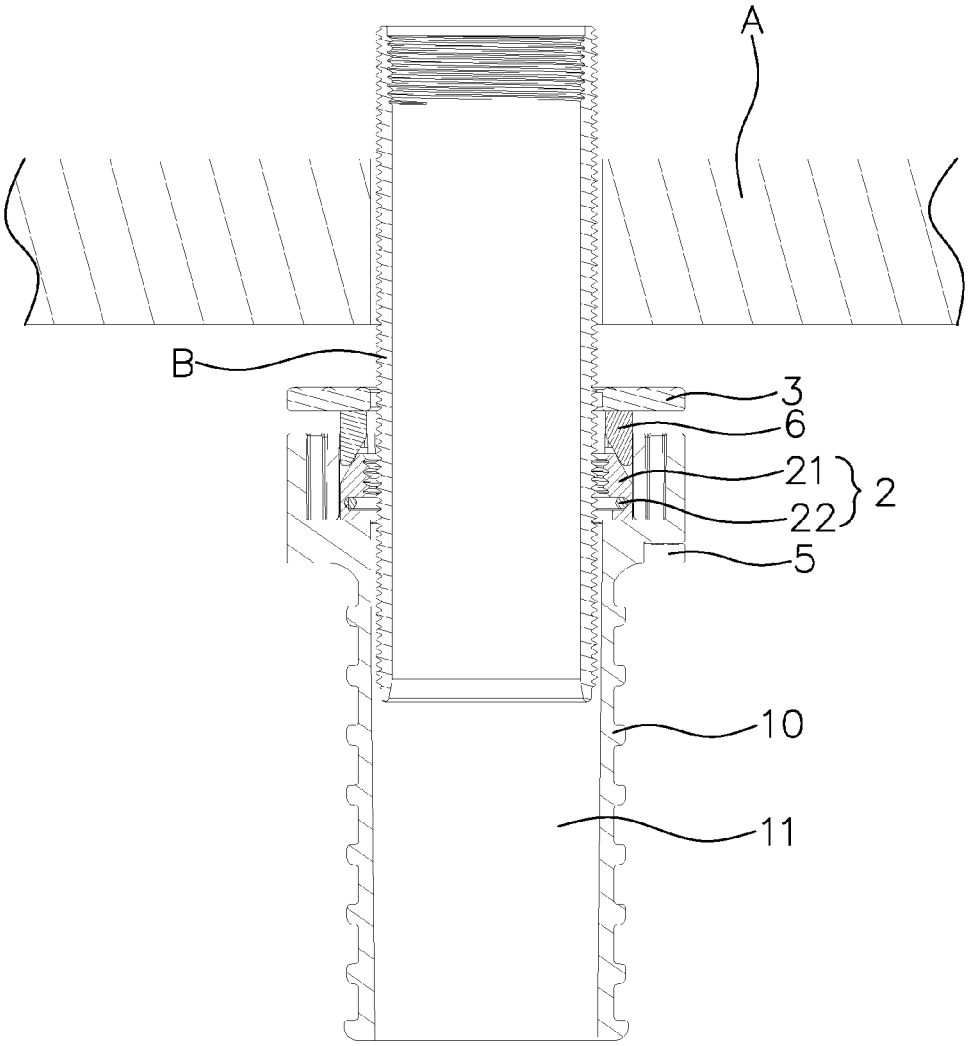
FIG. 2 is a sectional view of the preferred embodiment of the present invention cooperated with the bolt of the faucet (when not locked)
Figure 3:
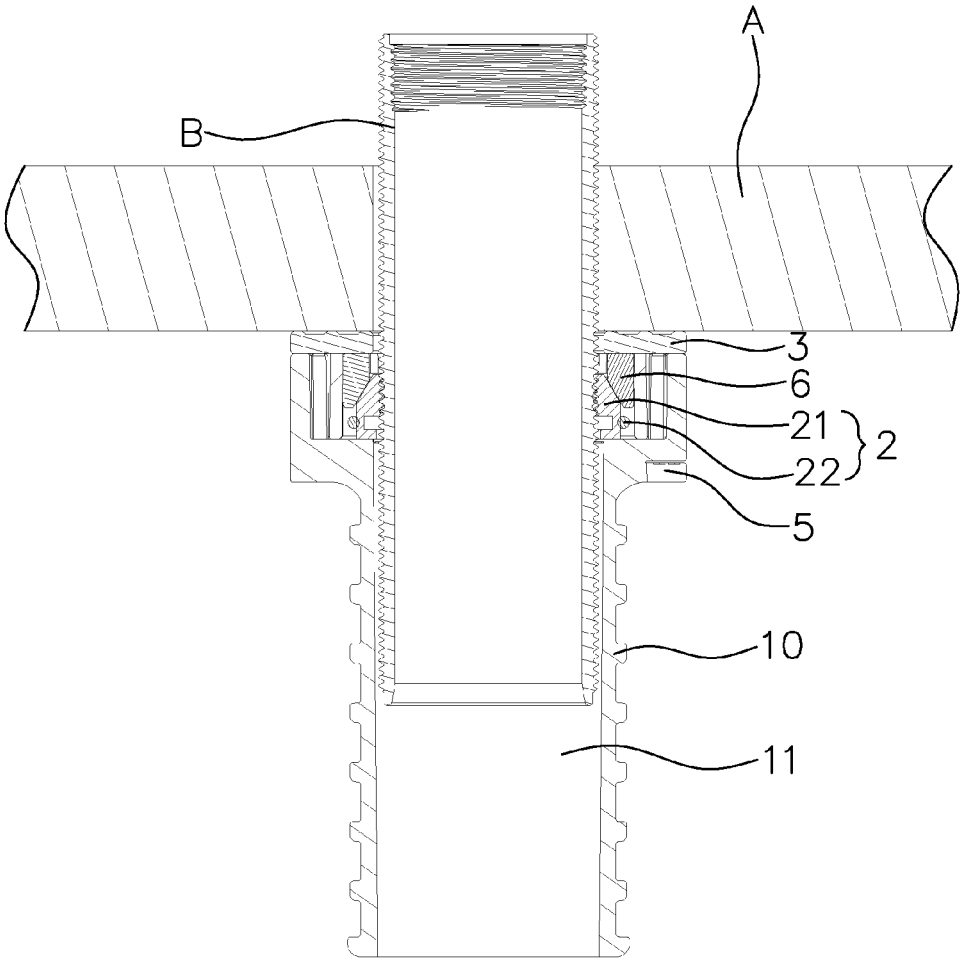
FIG. 3 is a sectional view of the preferred embodiment of the present invention cooperated with the bolt of the faucet (when locked)
Figure 4:
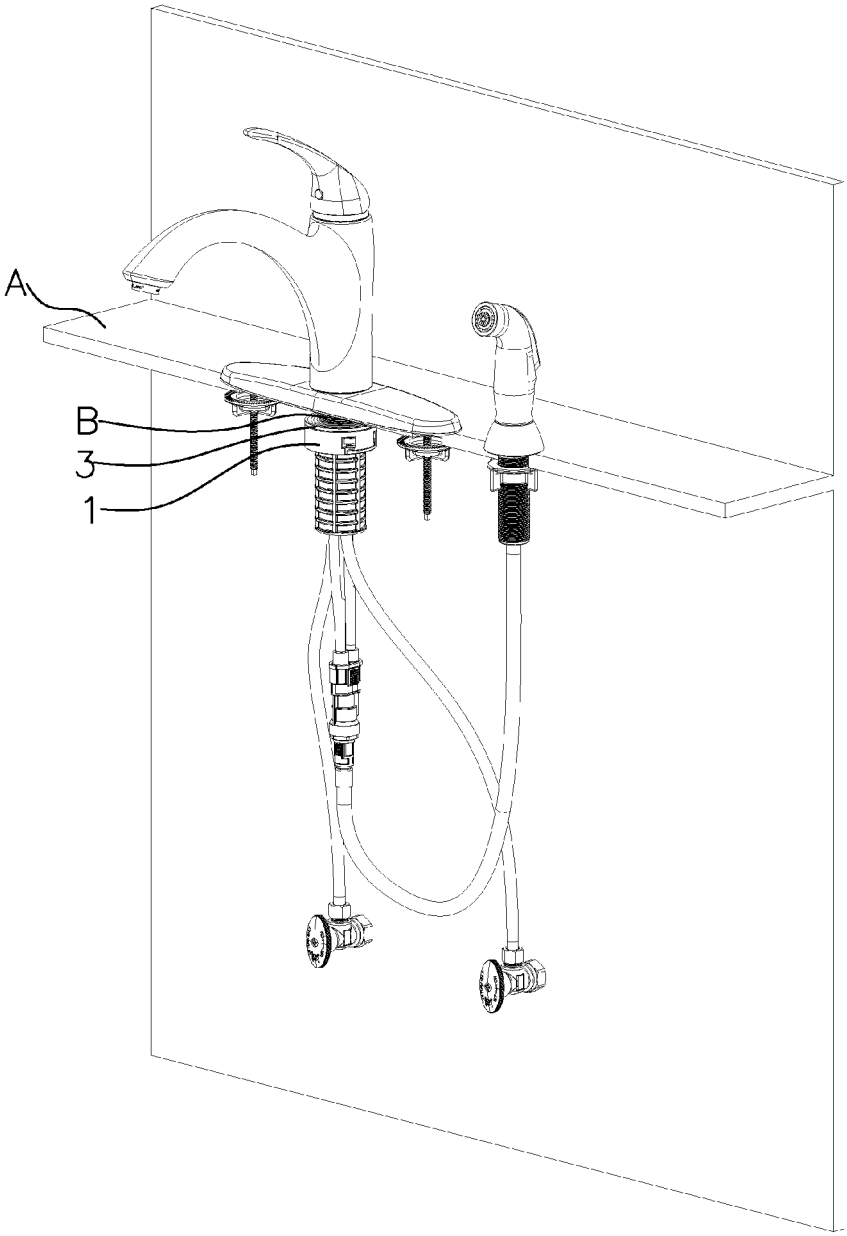
FIG. 4 is a schematic view after the faucet is installed.

FIG. 1 to FIG. 3 shows a first embodiment of the quick assembly and disassembly the present invention. Wherein, the drive portion 10 on the outer wall of the lower portion of the main body 1 is a plurality of transverse ribs for the user to grasp and apply a force. Two sides of the receiving seat 12 at the upper portion of the main body 1 are formed with two mate holes 121 which are arranged in a line.

A connecting ring 4 is provided in the receiving seat 12, and a buckle 5 is provided to connect the connecting ring 4 to the main body 1. The outer diameter of the connecting ring 4 corresponds to the inner diameter of the receiving seat 12. The connecting ring 4 has an end surface 41 at an upper end thereof, a socket 42 at a lower portion thereof for accommodating the movable lock block 2, a central through hole 411 for insertion of the bolt B, slots 412 on the end surface 41 for the push blocks 6 to pass through, mate holes 413 for the mate portions 33 of the press plate 3 to pass through, and a pair of notches 421 at the outer wall of the socket 42 of the connecting ring 4, corresponding to the mate holes 121 at the two sides of the receiving seat 12, for the buckle 5 to pass through transversely.

In this embodiment, the return elastic member 22 of the movable lock block 2 is a C-shaped ring disposed between the two movable blocks 21. The two movable blocks 21 each have a positioning groove 212 to cooperate with the C-shaped ring. The guide portion 214 on the outer wall of each movable block 21 is an inclined surface which is inclined outward from top to bottom.

To assemble the present invention, the two movable blocks 21 clip the C-shaped ring in the socket 42 of the connecting ring 4, and then is placed in the receiving seat 12 of the main body 1. The connecting ring 4 is secured in the main body 1 by the buckle 5. Meanwhile, the movable lock block 2 is confined in the connecting ring 4. The two push blocks 6 are placed in the slots 412 of the connecting ring 4. Finally, the two hooks 331 of the press plate 3 are aligned with the mate holes 413 of the connecting ring 4 to extend in the connecting ring 4. The two hooks 331 are engaged in the connecting ring 4 by deformation of the material, so that the push plate 3 and the connecting ring 4 are movably connected together. The push blocks 6 are located between the push plate 3 and the receiving seat 12 to constitute an anti-disengagement device accordingly for the demand of transportation. Subject to the confinement of the guide portion 214 of each movable block 21 and the return elastic member 22, normally, the push portions 61 of the push blocks 6 are located above the guide portions 214 of the movable blocks 21, namely, the upper end of the press plate 3 extends out of the upper end of the main body 1.

As shown in FIG. 2 and FIG. 3, when the present invention is used for installation of a faucet or other related parts, the main body 1 cooperating with the press plate 3 and the push blocks 6 is fitted on the bolt B from the lower end of the bolt B. Because the movable blocks 21 are subjected to the C-shaped ring, initially, the two movable blocks 21 have a retreat space and cannot be threaded to the bolt B, so that the main body 1 can be directly moved up to the position of the counter top A quickly. By applying an upward force to the main body 1, the counter top A has a downward force to the press plate 3, such that the press plate 3 presses the push blocks 6 to move downward relative to the main body 1, in the meanwhile, each push portion 61 pushes the inclined guide surface 214 of the corresponding movable block 21 for each movable block 21 to move toward the receiving cavity 11, such that the movable blocks 21 are threadedly connected with the bolt B for the faucet to be installed on the counter top A quickly. The connection of the faucet and the counter top A will be more stable and firm when the press plate 3 is further pressed downward for the movable blocks 21 to engage with the bolt B tightly. Meanwhile, the C-shaped ring is in a deformed and energized state.

To disassemble the faucet and its related parts, the main body 1 is rotated reversely to move downward relative to the bolt B, such that the counter top A doesn't hold against the press plate 3 and the press plate 3 doesn't press the lock block 2. The two movable blocks 21 of the lock block 2 are biased by the C-shaped ring to move outward to the initial state, namely, the movable blocks disengage from the bolt B. Thus, the main body 1 having the press plate 3 and the push blocks 6 is pulled to disengage from the bolt B quickly to achieve a quickly disassembly function.

To sum up, the present invention has the movable lock block 2 in the main body 1 and the press plate 3 and the push blocks 6 on the main body 1 to push the lock block 2. Normally, the main body 1 can be moved up and down on the bolt B of the faucet. It is not necessary to rotate the main body 1 from the bottom end of the bolt B. When the main body 1 is moved to the counter top A to compress the press plate 3, the press plate 3 will hold against the push blocks 6 to push the lock block 2 to mesh with the bolt B tightly, so that the faucet can be mounted and dismounted quickly. The assembly and disassembly of the faucet and the related parts is more convenient and quick.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick assembly and disassembly mechanism, cooperating with a bolt at a lower portion of a faucet, comprising a main body, a movable lock block disposed in the main body, a press plate which is movably disposed on the main body, and push blocks which are movably disposed on the main body and driven by the press plate;

the movable lock block being composed of at least two movable blocks and at least one return elastic member to return the at least two movable blocks outward, an inner wall of each movable block being formed with a mate surface corresponding to an outer wall of the bolt, the mate surface being provided with an anti-disengagement device; the press plate being an annular plate, a lower portion of the press plate being movably inserted in the main body, a lower surface of the press plate being in touch with upper surfaces of the push blocks, the push blocks corresponding in number to the movable blocks, each push block being formed with a push portion corresponding to a guide portion of the corresponding movable block, wherein when the push blocks are pressed into the main body, the push portions of the push blocks push the movable blocks to mesh with the bolt tightly, wherein an upper portion of the main body has a receiving seat, two sides of the receiving seat at the upper portion of the main body being formed with two mate holes which are arranged in a line, a connecting ring being provided in the receiving seat, a buckle being provided to connect the connecting ring to the main body, the connecting ring having an outer diameter corresponding to an inner diameter of the receiving seat, the connecting ring having an end surface at an upper end thereof, a socket at a lower portion thereof for accommodating the lock block, a central through hole for insertion of the bolt, mate holes for mate portions of the press plate to pass through, slots on the end surface for the push blocks to pass through, and a pair of notches at an outer wall of the socket of the connecting ring, corresponding to the mate holes at the two sides of the receiving seat, for the buckle to pass through transversely.

2. The quick assembly and disassembly mechanism as claimed in claim 1, wherein the anti-disengagement device is one of threads, teeth, knurls and protrusions.

3. The quick assembly and disassembly mechanism as claimed in claim 1, wherein the push portion and the guide portion are one of inclined surfaces, inclined groove, slide grooves, guide rails and guide grooves to mate with each other.

4. The quick assembly and disassembly mechanism as claimed in claim 1, wherein, an outer wall of the main body has a drive portion for applying a force.

5. The quick assembly and disassembly mechanism as claimed in claim 1, wherein the return elastic member of the movable lock block is a C-shaped ring disposed between the two movable blocks, the two movable blocks each having a positioning groove to cooperate with the C-shaped ring, the guide portion on an outer wall of each movable block being an inclined surface which is inclined outward from top to bottom.

6. A quick assembly and disassembly mechanism, cooperating with a bolt at a lower portion of a faucet, comprising a main body, a movable lock block disposed in the main body, a press plate which is movably disposed on the main body, and push blocks which are movably disposed on the main body and driven by the press plate; the movable lock block being composed of at least two movable blocks and at least one return elastic member to return the at least two movable blocks outward, an inner wall of each movable block being formed with a mate surface corresponding to an outer wall of the bolt, the mate surface being provided with an anti-disengagement device; the press plate being an annular plate, a lower portion of the press plate being movably inserted in the main body, a lower surface of the press plate being in touch with upper surfaces of the push blocks, the push blocks corresponding in number to the movable blocks, each push block being formed with a push portion corresponding to a guide portion of the corresponding movable block, wherein when the push blocks are pressed into the main body, the push portions of the push blocks push the movable blocks to mesh with the bolt tightly, wherein the return elastic member of the movable lock block is a C-shaped ring disposed between the two movable blocks, the two movable blocks each having a positioning groove to cooperate with the C-shaped ring, the guide portion on an outer wall of each movable block being an inclined surface which is inclined outward from top to bottom, an upper portion of the press plate is an end cap, and the end cap having a central through hole for insertion of the bolt and two hooks extending downward to form mate portions of the press plate.

* * * * *